US010527984B2

(12) United States Patent
Nanjo

(10) Patent No.: US 10,527,984 B2
(45) Date of Patent: Jan. 7, 2020

(54) FIXING DEVICE AND IMAGE FORMING APPARATUS

(71) Applicant: KYOCERA Document Solutions Inc., Osaka (JP)

(72) Inventor: Yuzuru Nanjo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/220,452

(22) Filed: Dec. 14, 2018

(65) Prior Publication Data

US 2019/0278204 A1 Sep. 12, 2019

(30) Foreign Application Priority Data

Mar. 8, 2018 (JP) ..... 2018-041822

(51) Int. Cl.
*G03G 15/20* (2006.01)
*G03G 15/16* (2006.01)

(52) U.S. Cl.
CPC ..... *G03G 15/2053* (2013.01); *G03G 15/16* (2013.01); *G03G 15/2025* (2013.01); *G03G 15/2064* (2013.01)

(58) Field of Classification Search
CPC ..... G03G 15/2053; G03G 15/2064; G03G 15/2025; G03G 2215/2035
USPC ..... 399/328, 329
See application file for complete search history.

(56) References Cited

U.S. PATENT DOCUMENTS 9,471,018 B2 10/2016 Kawaguchi
2005/0180788 A1 8/2005 Watanabe et al.
2005/0185994 A1* 8/2005 Inada ..... G03G 15/2053 399/328
2009/0041515 A1* 2/2009 Kim ..... G03G 15/2025 399/324
2015/0093167 A1* 4/2015 Hazeyama ..... G03G 15/2053 399/329
2015/0177658 A1 6/2015 Kasama
2016/0132003 A1 5/2016 Koda et al.
(Continued)

FOREIGN PATENT DOCUMENTS

JP 2016118708 A 6/2016

OTHER PUBLICATIONS

Extended European Search Report issued by the European Patent Office dated May 17, 2019, which corresponds to EP18211253.2-1022 and is related to U.S. Appl. No. 16/220,452.

*Primary Examiner* — Walter L Lindsay, Jr.
*Assistant Examiner* — Jessica L Eley
(74) *Attorney, Agent, or Firm* — Studebaker & Brackett PC

(57) ABSTRACT

The fixing device includes a fixing belt, a pressing member, a pushing member and a cap. The fixing belt is endless and rotatable. The pressing member is configured to form a pressing area with the fixing belt. The pushing member is configured to come into contact with an inner circumferential face of the fixing belt via a lubricant and to push the fixing belt to the pressing member at the pressing area. The cap is configured to be attached to an end portion of the fixing belt through an elastic member. The cap has a contact part with which an end face of the fixing belt comes into contact. The contact part has a groove configured to store the lubricant leaked from the fixing belt. The groove is formed such that a width is varied along a radial direction of the cap.

7 Claims, 5 Drawing Sheets

(56) References Cited

U.S. PATENT DOCUMENTS

2016/0179043 A1* 6/2016 Kawaguchi ..... G03G 15/2053
399/329

* cited by examiner

FIXING DEVICE AND IMAGE FORMING APPARATUS

INCORPORATION BY REFERENCE

This application is based on and claims the benefit of priority from Japanese Patent application No. 2018-041822 filed on Mar. 8, 2018, which is incorporated by reference in its entirety.

BACKGROUND

The present disclosure relates to a fixing device to fix a toner image on a sheet and an image forming apparatus including the fixing device.

In an image forming apparatus, a toner image formed on a surface of an image carrier is transferred on a sheet and then heated and pressed by a fixing device to be fixed on the sheet.

A fixing method of the fixing device includes a sliding type fixing method in which an endless fixing belt is driven by a pressing roller to be rotated. In the sliding type fixing method, the fixing belt is pressed to the pressing roller by a pushing pad. When a temperature detection position of the fixing belt is different from a heated position of the fixing belt by a heater, such as an IH heater, in a rotation direction of the fixing belt, if the rotation of the fixing belt is stopped, it becomes impossible to detect a temperature of the fixing belt, and an abnormal heat generation may occur. Then, for safety measure, the sliding type fixing device is provided with a rotation detection mechanism to detect the rotation of the fixing belt. The rotation detection mechanism detects a rotation of a cap which covers an end portion of the fixing belt and rotates together with the fixing belt. Between the fixing belt and the cap, an elastic member having a high friction coefficient is arranged so as to transfer the rotation of the fixing belt to the cap.

On the other hand, between the fixing belt and the pushing pad, in order to reduce a sliding load generated between the fixing belt and the pushing pad, a lubricant having a relatively low viscosity is applied. If the lubricant is flowed out from an inner circumferential face of the fixing belt and adheres to the elastic member, the elastic member is slipped, and the rotation of the fixing belt may not be transferred to the cap. Then, it is required to control the flow of the leaked lubricant.

Then, an elastic member may be provided, which thermally expands to come into contact with the inner circumferential face of the fixing belt and blocks the lubricant.

However, depending on a thermally expanded degree of the elastic member, the elastic member does not always come into contact with the inner circumferential face of the fixing belt. Additionally, because it is required to add a new member and to cause an increase in cost.

SUMMARY

In accordance with an aspect of the present disclosure, a fixing device includes a fixing belt, a pressing member, a pushing member and a cap. The fixing belt is endless and rotatable. The pressing member is configured to form a pressing area with the fixing belt. The pushing member is configured to come into contact with an inner circumferential face of the fixing belt via a lubricant and to push the fixing belt to the pressing member at the pressing area. The cap is configured to be attached to an end portion of the fixing belt through an elastic member and to be rotated together with the fixing belt. The cap has a contact part with which an end face of the fixing belt comes into contact. The contact part has a groove configured to store the lubricant leaked from the inner circumferential face of the fixing belt. The groove is formed such that a width is varied along a radial direction of the cap.

In accordance with an aspect of the present disclosure, an image forming apparatus includes an image forming part and the fixing device. The image forming part is configured to form a toner image on a sheet. The fixing device is configured to fix the toner image on the sheet.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus and a fixing device according to an embodiment of the present disclosure will be described.

Figure 1:
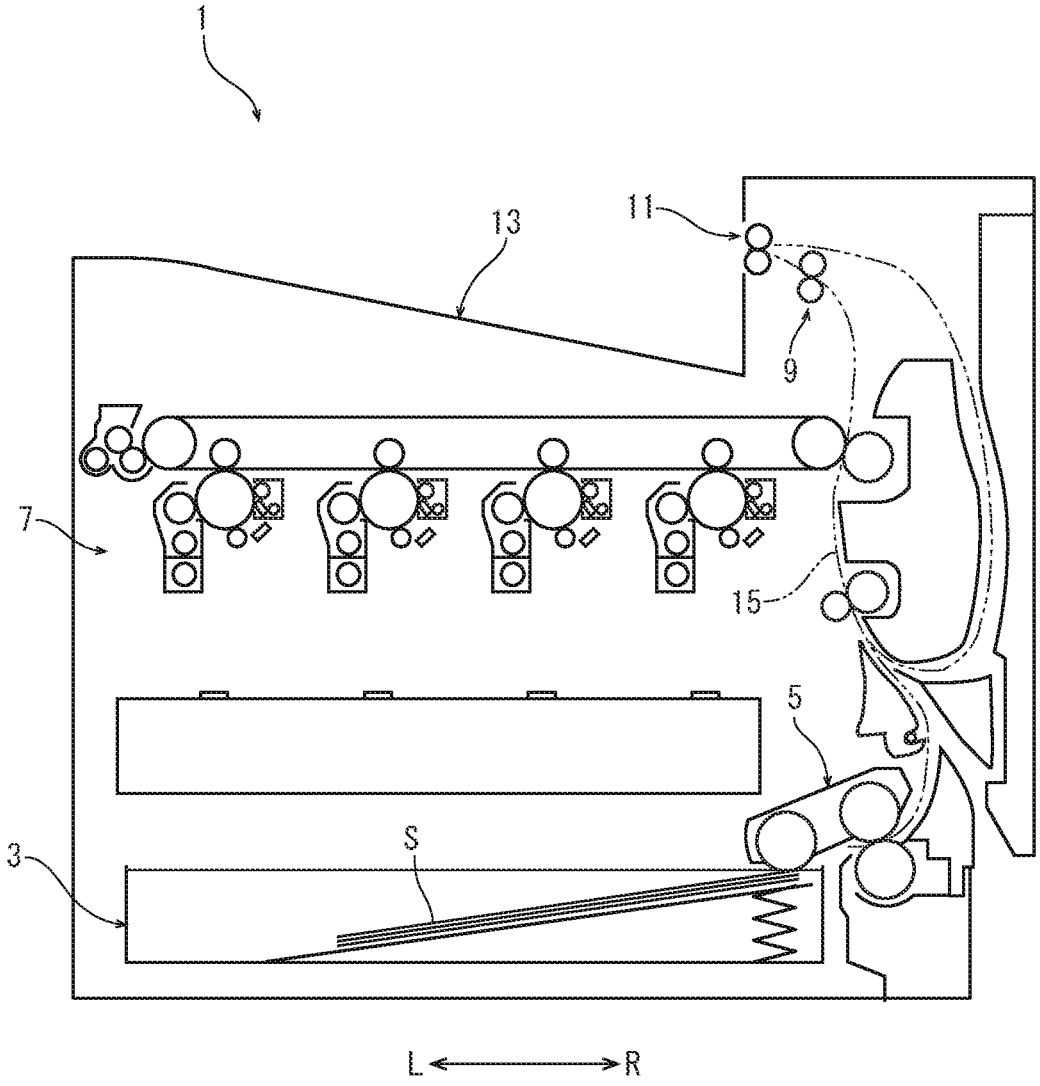
FIG. 1 is a schematic view showing an inner structure of a color printer according to one embodiment of the present disclosure.

First, with reference to FIG. 1, an entire structure of a color printer as an image forming apparatus will be described. FIG. 1 is a front view schematically showing an inner structure of the color printer. In the following description, a near side of a paper surface of FIG. 1 is defined to be a front side of the color printer 1. L and R shown in each figure respectively indicate a left side and a right side of the color printer 1.

An apparatus main body of the color printer 1 is provided with a sheet feeding cassette 3 storing a sheet S, a sheet feeding device 5 feeding the sheet S from the sheet feeding cassette 3, an image forming part 7 forming a full color toner image on the sheet S, a fixing device 9 fixing the toner image on the sheet S, an ejecting device 11 ejecting the sheet S and an ejected sheet tray 13 on which the ejected sheet S is stacked. In the apparatus main body, a conveyance path 15 for the sheet S is formed so as to extend from the sheet feeding device 5 to the ejecting device 11 through the image forming part 7 and the fixing device 9.

Figure 2:
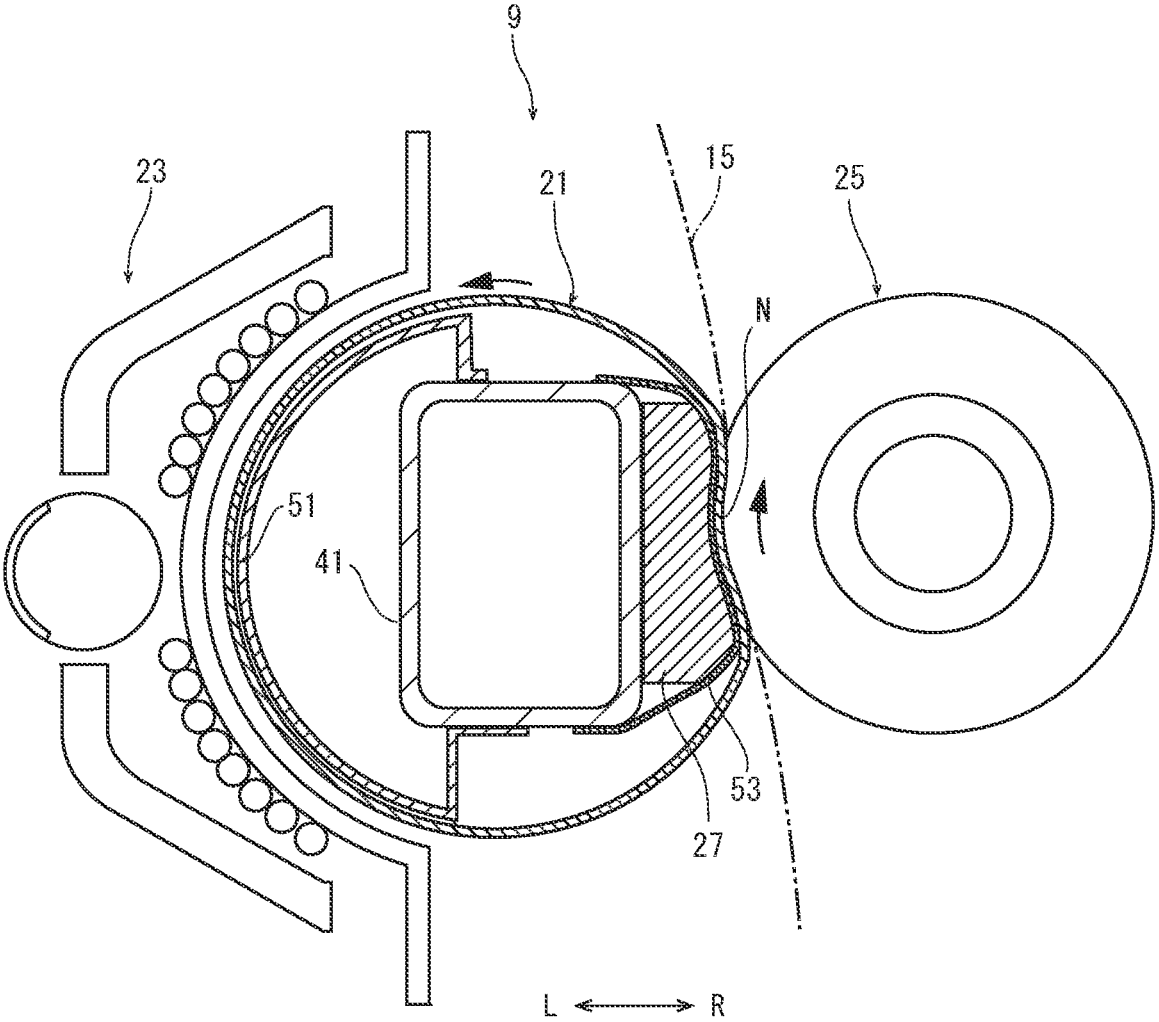
FIG. 2 is a sectional view showing a fixing device according to the embodiment of the present disclosure.

Next, the fixing device 9 will be described with reference to FIG. 2 and FIG. 3. FIG. 2 is a sectional view showing the fixing device and FIG. 3 is a sectional view showing an end portion of the fixing device.

As shown in FIG. 2, the fixing device 9 includes an endless fixing belt 21, an IH heater 23 which heats the fixing belt 21, a pressing roller 25 as a pressing member which forms a pressing area N with the fixing belt 21, a pushing pad 27 as a pushing member which pushes the fixing belt 21 to the pressing roller 25 at the pressing area N and a cap 31 (refer to FIG. 3) attached to an end portion of the fixing belt 21 via an elastic member 29 and rotating together with the fixing belt 21.

The fixing belt 21 is an endless belt having a predetermined inner diameter and a width longer than a width of the sheet S. The fixing belt 21 is made of flexible material, and has a base layer, an elastic layer provided around an outer circumferential face of the base layer and a release layer provided around an outer circumferential face of the elastic layer. The base layer is made of magnetic metal, such as Ni, or polyimide resin added with metal, such as Cu, Ag or Al. The elastic layer is made of silicon rubber or the like. The release layer is made of PFA tube or the like.

Figure 3:
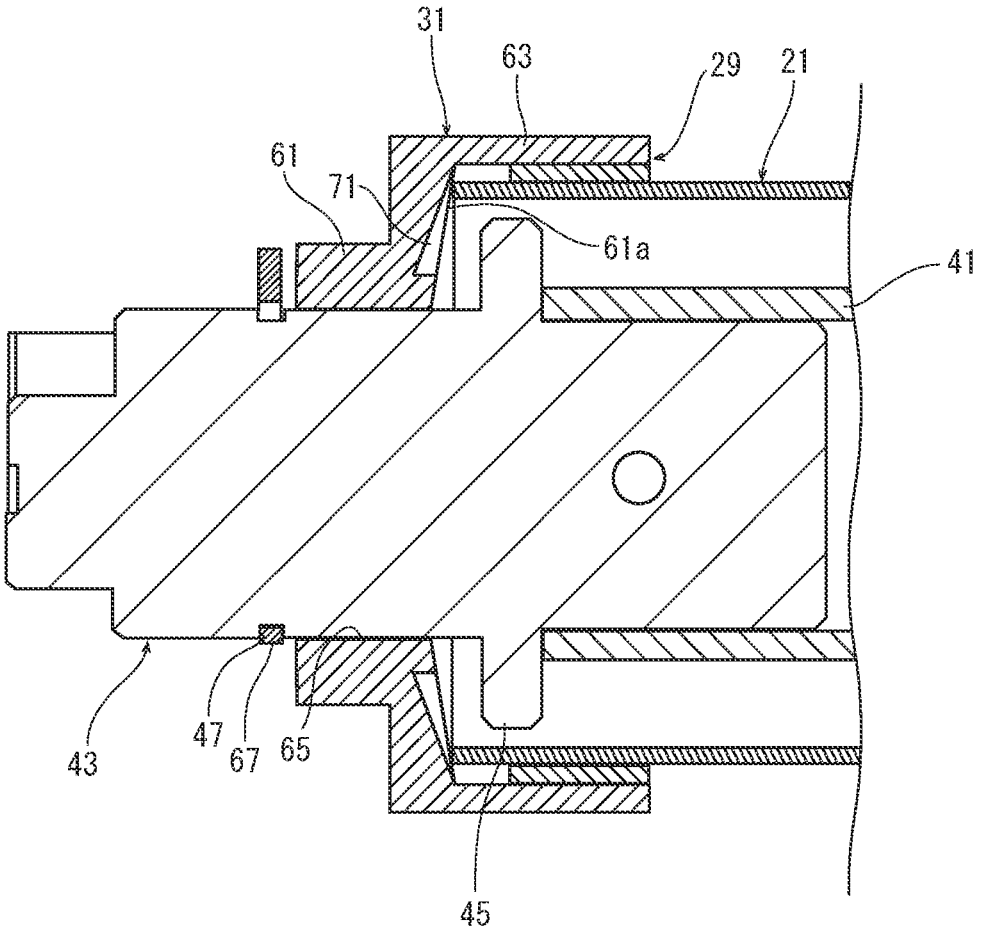
FIG. 3 is a sectional view showing an end portion of the fixing device according to the embodiment of the present disclosure.

As shown in FIG. 2 and FIG. 3, into a hollow space of the fixing belt 21, a holding member 41 is penetrated. The holding member 41 is a member formed in a rectangular cylindrical shape of a length shorter than the width of the fixing belt 21. As shown in FIG. 3, into each end opening of the holding member 41, a stay 43 is fitted. The stay 43 has an inserting part inserted into the end opening of the holding member 41 and a protruding part protruding from the end opening of the holding member 41. Between the inserting part and the protruding part, a flange part 45 is formed along a circumferential direction. The protruding part has an annular groove 47 along the circumferential direction. The inserting part is inserted into the end portion of the holding member 41 and an end face of the holding member 41 comes into contact with the flange part 45. Both the stays 43 are supported by a housing (not shown) of the fixing device 9.

As shown in FIG. 2, on one outer side face of the holding member 41, a belt guide 51 is supported, and on the other side face of the holding member 41, the pushing pad 27 is supported. The belt guide 51 has an arc-shaped cross section along the inner circumferential face of the fixing belt 21, and is made of material having a spring property. The belt guide 51 gives tension to the fixing belt 21 to stabilize a rotational path of the fixing belt 21. The pushing pad 27 is a member formed in an approximately shallow rectangular parallelepiped shape elongated in the width direction of the fixing belt 1, and made of resin, such as liquid crystal polymer. An outer circumferential face of the pushing pad 27 is covered by a sliding sheet 53. The sliding sheet 53 through which a lubricant is infiltrated comes into contact with the inner circumferential face of the fixing belt 21. The lubricant is a lubricant having a relatively low velocity, such as fluorine-based grease or silicon oil. When the fixing belt 21 is rotated, the sliding sheet 53 is slid with respect to the fixing belt 21.

The IH heater 23 includes a coil part, a coil bobbin holding the coil part and an arch core. The IH heater 23 is arranged so as to face the fixing belt 21 opposite to the belt guide 51. When high frequency AC voltage is applied to the coil part to generate magnetic field, the magnetic field generates eddy current in the base layer of the fixing belt 21 and to heat the base layer. This heats the fixing belt 21.

The pressing roller 25 includes a columnar core metal, an elastic layer provided around an outer circumferential face of the core metal and a release layer provided around an outer circumferential face of the elastic layer. The elastic layer is made of silicon rubber or the like. The release layer is made of PFA tube or the like.

The pressing roller 25 faces the fixing belt 21 at an opposite side of the pushing pad 27 and pressed against the pushing pad 27. Then, between the pressing roller 25 and the fixing belt 21, the pressing area N is formed. The pressing roller 25 is driven by a drive source (not shown) to be rotated in the clockwise direction in FIG. 2. When the pressing roller 25 is thus rotated, the fixing belt 21 is driven to be rotated in a counter direction to the rotation direction of the pressing roller 25 (in the counterclockwise direction in FIG. 2). Then, the conveyed sheet S is passed through the pressing area N.

Figure 4:
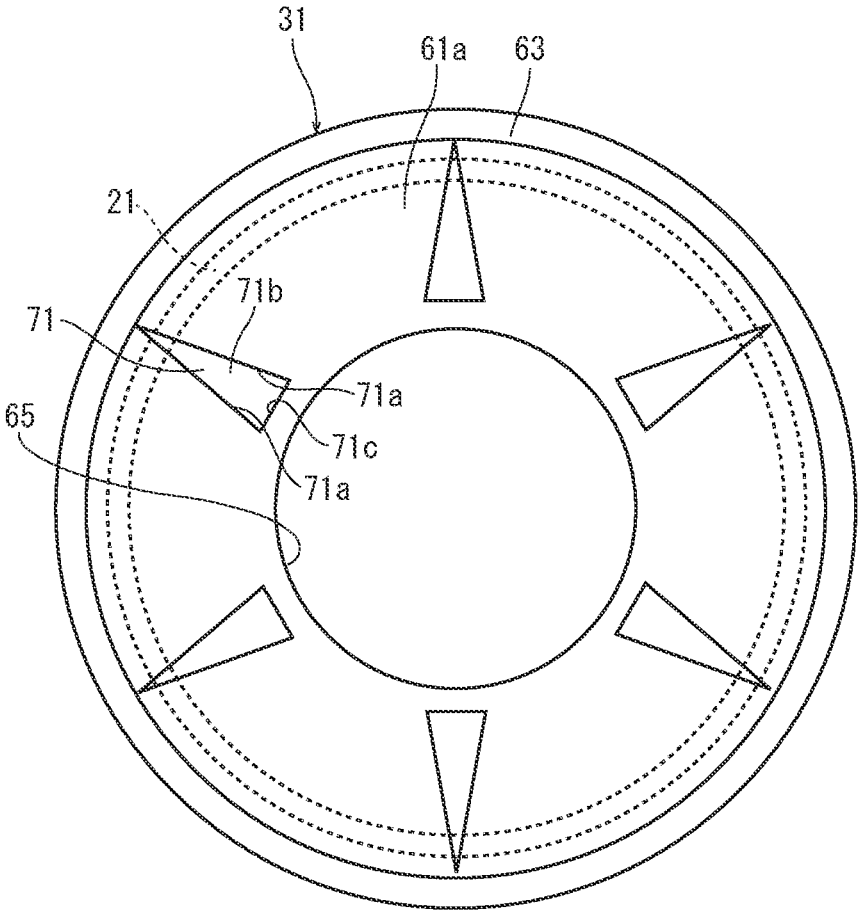
FIG. 4 is a front view showing a bottom wall of the cap, in the fixing device according to the embodiment of the present disclosure.

The cap 31 will be described with reference to FIG. 4 in addition to FIG. 3. FIG. 4 is a front view sowing a bottom wall of the cap.

The cap 31 is a resin molded member configured to cover each end portion of the fixing belt 21, and has a circular bottom wall 61 and a cylindrical outer circumferential wall 63 around an outer circumference of the bottom wall 61, as shown in FIG. 3. A through hole 65 is formed at a center of the bottom wall 61. On a bottom face (an inside face) of the bottom wall 61, an annular contact part 61*a* is formed around the through hole 65. The contact part 61*a* is inclined so as to be tapered toward an inner side in a radial direction of the cap 31 (toward the through hole 65).

Into the through hole 65 of the bottom wall 61, the protruding part of the stay 43 is inserted. The cap 31 is rotatable around the protruding part of the stay 43 between the flange part 45 of the stay 43 and a C-ring 67 attached to the annular groove 47. With the contact part 61*a* of the cap 31, an end face of the fixing belt 21 comes into contact. Between the outer circumferential wall 63 of the cap 31 and the outer circumferential face of the fixing belt 21, a predetermined gap is formed.

As shown in FIG. 4, on the contact part 61*a* of the bottom wall 61, a plurality of (six, in the embodiment) grooves 71 is formed. Each groove 71 is formed along the radial direction of the cap 31. The grooves 71 are arranged at predetermined intervals in a circumferential direction of the cap 31. In detail, the groove 71 is formed between a position slightly separated from a side wall of the through hole 65 and the outer circumferential wall 65. The groove 71 has a width which is increased from the outer side to the inner side in the radial direction. That is, the groove 71 has a plane shape of an isosceles triangle of which a base angle is larger than an apex angle. The groove 71 has a depth which is gradually increased from the outer side to the inner side in the radial direction. That is, the groove 71 is formed in a quadrangular pyramid shape. For example, in a case where the cap 31 has a diameter of 30 mm, a number of the groove 71 is 40, a length along the radial direction of the groove 71 is 2.0 mm, a depth of the deepest portion of the groove 71 is 1.0 mm, a width of an opening face of the groove 71 is 1.0 to 2.0 mm, and the apex angle of the groove 71 is 5 to 60 degrees.

In the gap between the outer circumferential face of the fixing belt 21 and the outer circumferential wall 63 of the cap 31, an elastic member 29 is interposed. The elastic member 29 has a cylindrical shape, and made of material having a high friction coefficient, such as silicon rubber. When the fixing belt 21 is rotated as described above, the rotation of the fixing belt 21 is transmitted to the cap 31 through the elastic member 29.

A fixing operation of the fixing device 9 having the above described configuration will be described. First, the pressing roller 25 is driven by the drive source to be rotated, and the fixing belt 21 is driven to be rotated in the rotation direction opposite to the pressing roller 25 (in the clockwise direction in FIG. 2). At the same time, the IH heater 23 is driven to heat the fixing belt 21. The fixing belt 21 is heated to a predetermined control temperature (for example, 160° C.). After the fixing belt 21 is heated in the above manner, the sheet S on which the toner image is transferred is conveyed to the pressing area N. At the pressing area N, the sheet S is heated by the fixing belt 21 and pressed between the fixing belt 21 and the pressing roller 25. As a result, the toner image is fixed on the sheet S. The sheet S on which the toner image is fixed is conveyed along the conveyance path 15.

When the fixing belt 21 is rotated, the cap 31 is rotated through the elastic member 29. Then, a rotation detecting mechanism (not shown) detects the rotation of the cap 31, and it is judged that the fixing belt 21 is rotated normally.

In the above fixing operation, because the lubricant is applied on the outer circumferential face of the pushing pad 27 (the sliding sheet 53), a sliding load applied to the fixing belt 21 from the pushing pad 27 is reduced so that the fixing belt 21 is rotated smoothly. On the other hand, when the fixing belt 21 is rotated, the end face of the fixing belt 21 comes into contact with the contact part 61*a* of the bottom wall 61 of the cap 31. At this time, the lubricant transferred on the inner circumferential face of the fixing belt 21 from the pushing pad 27 may be leaked to the contact part 61*a* of the bottom wall 61 from the end face of the fixing belt 21. The leaked lubricant is introduced to the grooves 71 and then stored in the grooves 71.

As described above, according to the fixing device 9 of the present disclosure, the lubricant leaked from the end portion of the fixing belt 21 is introduced to the grooves 71 and then stored in the grooves 71. That is, the lubricant is not leaked to a side of the elastic member 29 so that it becomes possible to avoid a case where the leaked lubricant adheres to the elastic member 29 and the fixing belt 21 is slipped with respect to the elastic member 29. Accordingly, it becomes possible to transfer the rotation of the fixing belt 21 to the cap 31 through the elastic member 29 surely and to correctly detect the rotation of the fixing belt 21 by the rotation detection mechanism.

Conventionally, a liquid, such as the lubricant, is applied with force for reducing its surface area owing to intermolecular force. The intermolecular force acts between the liquid and a contact portion in contact with the liquid. Considering the above fact, as shown in FIG. 4, the lubricant entered inner corners of the groove 71 (each corner of the triangle) is stably held owing to the intermolecular force with both side walls 71*a* and a bottom wall 71*b* of the groove 71 or with each side wall 71*a*, an end wall 71*c* and the bottom wall 71*b* of the groove 71. In the other words, at the corner surrounded by the above three walls, a surface area of the contact portion in contact with the lubricant is increased so that the lubricant is held stably. On the other hand, the lubricant facing the opening face of the groove 71 is relatively unstable because the intermolecular force from the opening face side (the air side) is not acted. However, the lubricant facing the opening face of the groove 71 is attracted by the intermolecular force of the lubricant entered the inner corners so as to be stably held in the groove 71.

The fixing belt 21 may be meandered depending on a pressure variation at the pressing area N. When the fixing belt 21 is meandered, as the contact area between the end face of the fixing belt 21 and the contact part 61*a* of the cap 31 is large, a damage applied to the fixing belt 21 from the cap 31 is small. The end face of the fixing belt 21 comes into contact with the contact part 61*a* of the cap 31 at the outer side in the radial direction (the side of the outer circumferential wall 63). As described above, because the groove 71 has a plane shape of an isosceles triangle whose width is increased from the outer side to the inner side in the radial direction, a surface area of the contact area between the end face of the fixing belt 21 and the contact part 61*a* of the cap 31 is relatively large at the contact portion between the fixing belt 21 and the cap 31. Accordingly, it becomes possible to reduce the damage applied to the fixing belt 21 from the cap 31 when the fixing belt 21 is meandered.

On the other hand, at the inner side from the contact portion in the radial direction, the width and the depth of the groove 71 are increased so that an amount of the lubricant stored in the groove 71 can be increased. However, the groove 71 may be formed such that the depth is decreased from the outer side to the inner side in the radial direction or the depth is uniform in the radial direction.

Additionally, as shown in FIG. 2, at the pressing area N, the fixing belt 21 is pressed by the pressing roller 25 to be deflected inwardly. Then, the end face of the fixing belt 21 is shifted on the contact part 61*a* of the bottom wall 61 of the cap 31 inwardly along the radial direction of the cap 31. As described above, the contact part 61*a* is inclined to be tapered from the outer side to the inner side in the radial direction of the cap 31. In other word, the contact part 61*a* is inclined from the outer side to the inner side in the radial direction of the cap 31 toward an outer side in the rotation direction of the fixing belt 21. Accordingly, when the fixing belt 21 is deflected inwardly at the pressing area N, it becomes possible to reduce the deflected amount of the end portion of the fixing belt 21 and to prevent (metal) fatigue fracture of the fixing belt 21 owing to bending of the end portion of the fixing belt 21. Additionally, a friction between the end face of the fixing belt 21 and the contact part 61*a* is reduced so that it becomes possible to rotate the fixing belt 21 smoothly. Additionally, it becomes possible to prevent an abrasion of the end face of the fixing belt 21.

Figure 5:
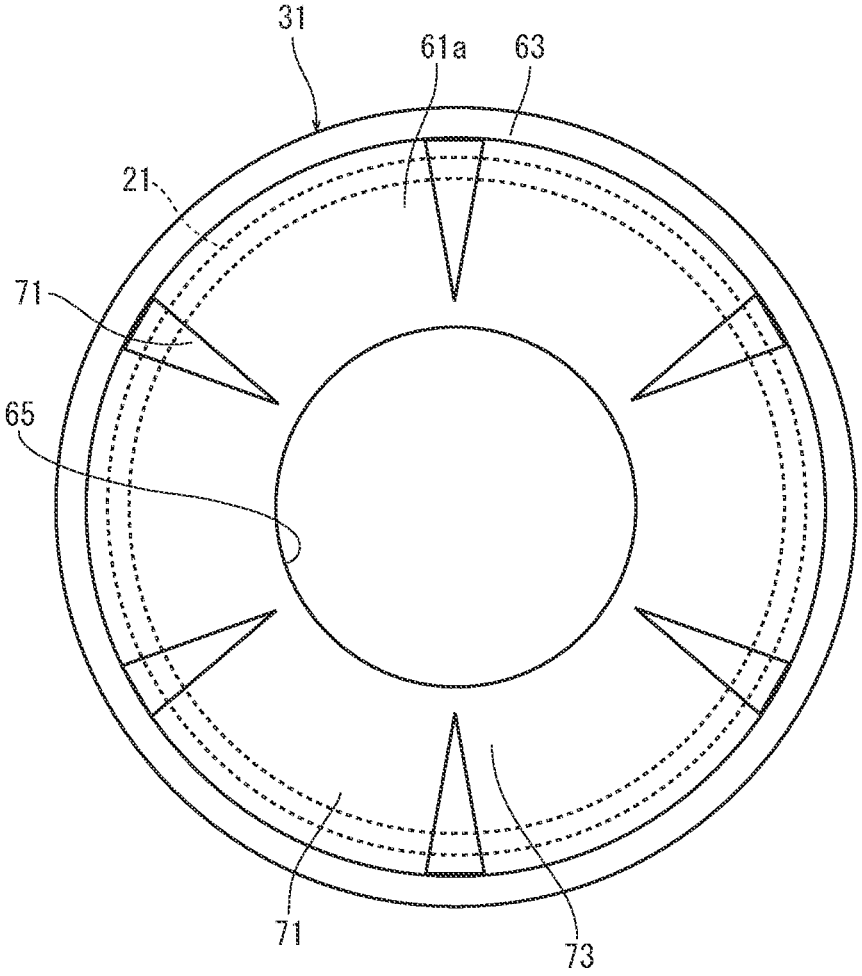
FIG. 5 is a front view showing a modified example of the bottom wall of the cap, in the fixing device according to the embodiment of the present disclosure.

Next, with reference to FIG. 5, a modified example of the groove 71 will be described. FIG. 5 is a front view showing the bottom wall of the cap.

In the modified example, the groove 71 has a plane shape of a triangle whose width is decreased from the outer side to the inner side in the radial direction. Additionally, the groove 71 has a depth which is increased from the inner side to the outer side in the radial direction.

As described above, the fixing belt 21 is pressed by the pressing roller 25 and deflected inwardly at the pressing area N, and then deflected outwardly to be returned to its original shape after passed through the pressing area N. At this time, the end face of the fixing belt 21 scrapes the lubricant leaked on the contact part 61*a* toward the outer side in the radial direction. The scarped lubricant is stored in the groove 71. The groove 71 has a width and a depth which are increased from the inner side to the outer side in the radial direction, that is, the groove 71 has a volume larger at the outer side than at the inner side. Thereby, the scraped lubricant can be stored in the groove 71. Additionally, because the apex angle at the inner side in the radial direction is smaller than the base angle at the outer side in the radial direction, the scraped lubricant tends to be stored in a tip portion of the groove, that is, the inner corner at the inner side in the radial direction owing to its intermolecular force. Thereby, the fixing belt 21 coming into contact with the contact part 61*a* at the outer side in the radial direction is separated from the stored lubricant so that it becomes possible to prevent the lubricant from adhering to the end portion of the fixing belt 21 again.

The groove 71 may have a plane shape of a trapezoid shape whose width is increased toward the outer side or the inner side in the radial direction. The corners between each side wall and the end wall, between each side wall and the bottom wall and between the end wall and the bottom wall of the groove 71 may be formed in an acute angle or an obtuse angle, or may be curved.

According to the present disclosure, it becomes possible to prevent the rotational failure of the fixing belt 21 owing to the leaked lubricant by modifying the shape of the cap 31 without adding a new member.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A fixing device comprising:

a rotatable endless fixing belt;

a pressing member configured to form a pressing area with the fixing belt;

a pushing member configured to come into contact with an inner circumferential face of the fixing belt via a lubricant and to push the fixing belt to the pressing member at the pressing area; and a cap configured to be attached to an end portion of the fixing belt through an elastic member and to be rotated together with the fixing belt, wherein the cap has a contact part with which an end face of the fixing belt comes into contact, the contact part has a groove configured to store the lubricant leaked from the inner circumferential face of the fixing belt, and the groove is formed such that a width is varied along a radial direction of the cap.

2. The fixing device according to claim 1, wherein the width is increased toward an inner side along the radial direction.

3. The fixing device according to claim 1, wherein the width is decreased toward an inner side along the radial direction.

4. The fixing device according to claim 1, wherein the groove is shaped in a pyramid.

5. The fixing device according to claim 1, wherein the groove has an inner corner surrounded by three walls.

6. The fixing device according to claim 1, wherein the contact part is inclined toward an inner side in the radial direction to an outer side in a rotation axis direction of the fixing belt.

7. An image forming apparatus comprising:

an image forming part configured to form a toner image on a sheet; and the fixing device, according to claim 1, configured to fix the toner image on the sheet.

* * * * *